US008312809B2

(12) United States Patent
Salda

(10) Patent No.: US 8,312,809 B2
(45) Date of Patent: Nov. 20, 2012

(54) SCREW PRESS FOR COMPACTING SOLID WASTE

(75) Inventor: Luciano Salda, Vignola (IT)

(73) Assignee: C.M.S. S.p.A., Marano sul Panaro, Province of Modena (IT)

( * ) Notice: Subject to any disclaimer, the term of this patent is extended or adjusted under 35 U.S.C. 154(b) by 556 days.

(21) Appl. No.: 12/522,007

(22) PCT Filed: Jan. 17, 2008

(86) PCT No.: PCT/EP2008/050498

§ 371 (c)(1), (2), (4) Date: Jul. 2, 2009

(87) PCT Pub. No.: WO2008/087183

PCT Pub. Date: Jul. 24, 2008

(65) Prior Publication Data

US 2010/0083850 A1 Apr. 8, 2010

(30) Foreign Application Priority Data

Jan. 18, 2007 (IT) ..... BO2007A0021

(51) Int. Cl.
*B30B 3/00* (2006.01)
*B30B 9/14* (2006.01)

(52) U.S. Cl. ..... 100/145; 100/117; 100/150

(58) Field of Classification Search ..... 100/117, 100/145, 146, 150, 215
See application file for complete search history.

(56) References Cited

U.S. PATENT DOCUMENTS 1,506,036 A * 8/1924 Willmarth ..... 44/630
2,515,455 A * 7/1950 Lipton ..... 126/59.5
3,267,839 A * 8/1966 Crane ..... 425/351
3,300,811 A 1/1967 Amedee
3,777,658 A * 12/1973 Vosskuhler ..... 100/98 R
4,553,285 A * 11/1985 Sachs et al. ..... 110/223
4,947,743 A * 8/1990 Brown et al. ..... 100/45
5,732,618 A * 3/1998 Buehl ..... 100/45
(Continued)

FOREIGN PATENT DOCUMENTS

DE 11 66 460 3/1964
(Continued)

*Primary Examiner* — Jimmy T Nguyen

(74) *Attorney, Agent, or Firm* — Stites & Harbison PLLC; Marvin Petry

(57) ABSTRACT

Screw press, with small dimensions, particularly suitable for the compaction of solid waste for disposal also using sorted-waste collection. The screw press comprises an initial large-diameter screw section with a wide-pitch helix, communicating laterally with the bottom opening of the loading hopper (1) in order to remove the material from the hopper and feed it to a following small-diameter screw section with a small-pitch helix, surrounded by an internally scored stator body. This produces the feeding and compaction of the material which also occurs in conjunction with the action of a constriction which acts on the discharge mouth of this latter screw section. A press of this type has the two screw sections (3, 4) which are separated and arranged parallel to each other and one above or around each other, so as to form overall a press which no longer has as its length the sum of the lengths of the two screw sections. Instead, it has a length corresponding to the length of the longer of the two screw sections. The two screw sections are operated at different speeds, with the second compacting screw section (4) rotating at a speed greater than that of the first feeder screw section.

6 Claims, 4 Drawing Sheets

U.S. PATENT DOCUMENTS 7,028,610 B1 * 4/2006 Ralicki ..... 100/37

FOREIGN PATENT DOCUMENTS

| | | |
|---|---|---|
| DE | 34 29 848 | 2/1986 |
| EP | 239858 | 10/1987 |
| EP | 0 790 122 | 8/1997 |
| EP | 1 721 728 | 11/2006 |
| GB | 792 870 | 4/1958 |
| GB | 1 282 959 | 7/1972 |
| IT | BO2004-U78 | 9/2004 |
| WO | WO 02/02867 | 1/2002 |
| WO | WO 2004/062900 | 7/2004 |
| WO | WO 2007/057293 | 5/2007 |

* cited by examiner

SCREW PRESS FOR COMPACTING SOLID WASTE

BACKGROUND OF THE INVENTION

The invention relates to screw presses used in the compaction of solid waste for disposal, for example, in bags or other waste collection containers, i.e. presses for example of the type used in machines which the same Applicant produces for compacting plates, cutlery and bottles made of plastic, food and beverage left-overs, napkins or serviettes used, for example, in catering activities.

SUMMARY OF THE INVENTION

For this purpose, the state of the art teaches the use of frustoconical screw presses, with helices having a diameter and pitch decreasing towards the discharge mouth. Presses of this type are described, for example, in the German patent DE 3,429,848 and in the European patents EP 239,858, EP 790, 122 and EP 1,193,045. All the presses of the known type are arranged with their axis horizontally, so that they occupy a considerable volume in plan view and must be positioned at a considerable distance from the ground in order to be able to position directly underneath their discharge mouth a container sufficiently high and with a big enough capacity to receive the compacted material. The screw of the presses is supported projecting at the end where it is motor-driven, usually by means of bearings which are subject to high concentrated radial forces due to their significant weight and the considerable length of the said screw when the latter is not supported by the material to be compacted.

In order to reduce the dimensions of the press, in particular the longitudinal dimensions of the machine which uses such a press, the Applicant is the proprietor of the Italian industrial model registration No. 257,243 filed on Aug. 1, 2003, in which the screw press is inclined upwards with its discharge mouth, so that its longitudinal axis forms with the bottom horizontal surface an angle greater than 20°, for example in the region of 40°-60°. With this solution the longitudinal plan dimensions of the press are reduced, large-capacity high containers may be positioned underneath its discharge mouth, and the flexural stresses of the screw on the support bearings are reduced, thereby reducing the radial load concentrated on these bearings. With this solution it is possible to limit the dimensions of a compacting machine with screw press of the type mentioned above to about 1 meter in terms of the length and about 650 mm in terms of the width.

Since several screw presses must be arranged alongside each other in order to form a compacting machine which can be used for sorted-waste collection, the dimensions of such a machine increase considerably and limit the positioning thereof in spaces. The invention intends to limit substantially the lengthwise dimensions of a screw press for compacting machines, with the solution according to Claim 1) and the subsequent dependent claims, based on the following proposed idea. The current screw presses are formed by an initial large-diameter section with wide-pitch helices, which communicates laterally with the loading hopper and comprises a successive small-diameter section with a gradually decreasing pitch, which is about as long as the first section and is completely surrounded by the internally scored body of the press. The first section of the screw must move and grip the material fed loose inside the hopper and must feed it to the second section which performs compaction thereof. In order to solve the problem mentioned above, the proposed solution consists in separating the two screw sections and arranging them parallel one above or around the other one, so as to form overall a screw which no longer has as its length the sum of the lengths of the two sections, but has a length corresponding to the length of the longer of the two sections. With this solution it is possible to provide compacting machines with a length of about 650 mm and width of about 650 mm, with the obvious advantages arising therefrom when several presses must be arranged alongside each other in order to perform sorted-waste collection. This solution also has the advantage that the two screws may be operated at different speeds and in particular the first large-diameter and wide-pitch screw may be operated at a speed which is less than that of the smaller-diameter compacting screw, so that the said first screw is able to grip slowly and gradually the material to be fed, even though the latter is pushed downwards with a limited force. According to a preferred embodiment of the invention, the first feeder screw has only helical vanes and is axially hollow so as to surround a section of the second compacting screw, preferably arranged coaxially. According to one variant, the feeder screw is situated laterally and above a section of the compacting screw.

BRIEF DESCRIPTION OF THE DRAWINGS

Further characteristic features of the invention and the advantages arising therefrom will become clearer from the following description of some preferred embodiments thereof, illustrated purely by way of a non-limiting example, in the figures of the four accompanying sets of drawings in which.

DETAILED DESCRIPTION OF THE PREFERRED EMBODIMENTS

Figure 3:
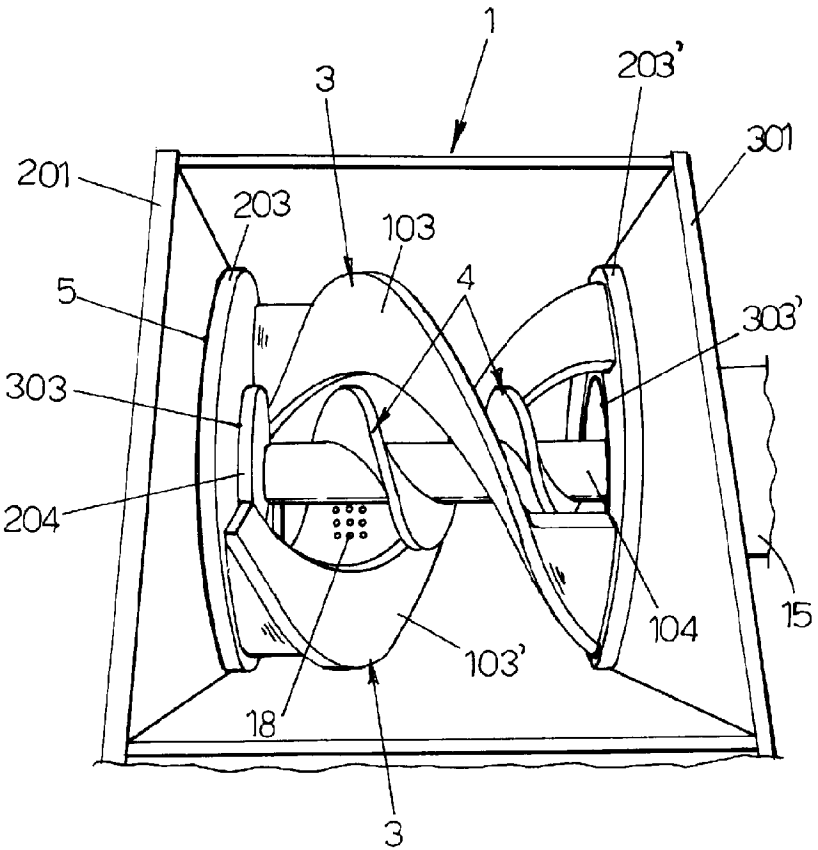
FIG. 3 shows a perspective view from above of the same press according to FIGS. 1 and 2.

From FIGS. 1, 2 and 3 it can be seen that the press comprises a loading hopper 1, the bottom 101 of which is rounded, with the centre of curvature on the axis 2 of rotation of the cylindrical screws which operate in the bottom of this hopper and which comprise a large-diameter screw 3 with wide-pitch helices, which is axially hollow (see below) and is engaged internally, with a coaxial arrangement, by a small-diameter and small-pitch screw 4. The inner screw has an outer diameter which is slightly smaller than that of the inner cavity of the outer screw 3 and has a pitch which is for example four times that of the said outer screw. It is understood that the illustration is a constructional example and that other proportions may be used, also depending on the specific requirements resulting from the material to be treated.

The outer screw 3 is, for example, of the type with two threads and is formed by only the two helices 103, 103' which are offset by 180° with respect to each other and which each cover half the pitch and are welded with their ends to a pair of circular and parallel plates 203, 203' provided with respective axial and concentric holes 303, 303'. The plate 203, as shown in detail in FIG. 4, engages rotatably a corresponding hole 5 provided on the adjacent end wall 201 of the hopper 1 which, on its outer side, has fixed thereto with an associated flange 106 a box 6 which by means of radial bearings 7 supports rotatably a bush 8 which has, keyed on the outer end, a pinion 9 of suitable diameter and which has integral therewith on the inner end a flange 108 on which the said end plate 203 of the larger screw 3 is fixed. 10 denotes any suitable annular sealing means which are situated on the inner side of the bearing 7 so as to protect the latter.

The pinion 9 and the said flange 108 are designed to support the outer ring of axially/radially acting bearings 11, 11' which rotatably support the end of the shaft 104 of the inner screw 4, and the outer end of this same shaft has, keyed thereon, a pinion 12 of suitable diameter. The pinions 9 and 12 derive rotation for example from a centralized gear motor unit 13 which is fixed, for example, to a lateral and bottom extension 401 of one of the end walls 201, 301 of the hopper 1 and the slow shaft of which has, keyed thereon, pinions 109, 112 which by means of respective chains 209, 212 transmit the necessary rotation to the said pinions 9, 12 and to the parts kinematically associated with them. In FIGS. 2, 309 and 312 denote tensioning devices which act on the untensioned sections of the said chains. The abovementioned pinions have diameters such that the inner screw 4 rotates at a speed which is suitably greater than that of the outer screw 3.

The direction of the screws 3 and 4 is the same and the direction of rotation thereof will be such that the material is displaced towards the plate 203'. The material introduced into the hopper 1 is dislodged and moved towards the bottom by the slow outer screw 3 so as to be taken up by the helices of the inner screw 4 which, owing to the relative movement of the two screws, moves the material in the direction of the axial hole of the plate 203' of the said outer screw. The screw section 4 which operates inside the hopper 1 uses the internal diameter of the outer screw 3 as a reaction chamber so as to be able to start axial discharging and compaction of the waste fed by the said outer screw 3. The operating speeds of the two screws can be easily determined experimentally, also depending on the type of material to be compacted, and so they are not indicated in detail here.

Figure 4:
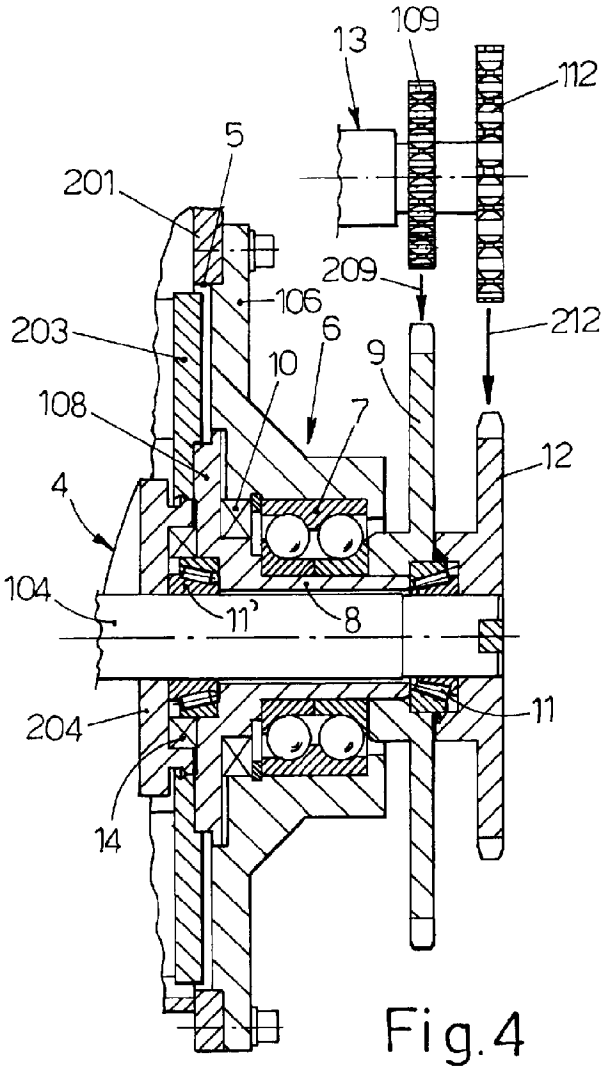
FIG. 4 shows, cross-sectioned, the set of bearings which support the screws at the end where they are connected to the rotational drive system.

From FIG. 4 it can be seen that, in the region of the plate 203, the shaft 104 of the inner screw 4 has integral therewith a plate 204 which, with its inner collar, engages in a partly rotatable manner the central hole of the said plate 203, and annular sealing means 14 for protecting the bearings 11' and 11 are provided between this plate 204 and the adjacent flange 108.

The inner screw 4 has a single cylindrical helix with a pitch decreasing towards the discharge outlet or more simply constant as shown in the drawings and has a length such as to project over a suitable section from the central hole of the plate 203' of the outer screw 3 and this projecting section operates inside a short tubular stator 15, the discharge mouth 115 of which has a "flute tip" form with a downwards inclination and this stator is provided with an intermediate flange 215 which is fixed on the end wall 301 of the hopper 1 and with its section passes through a hole provided in this wall and rotatably engages the central hole of the said plate 203', so as to emerge inside the hopper 1. The inner side surface of the stator 15 is provided with longitudinal recessed and/or raised scoring 16 which is necessary for ensuring that the screw imparts the axial feeding component to the compacted material, and similar scoring (not shown) may also be provided inside the hopper 1.

A constriction device of the known type 17 acts on the discharge mouth 115 of the stator 15; such a device is described, for example, in Italian patent application No. BO2005A-693 in the name of the same Applicant and assists the compression and compaction of the material discharged by the inner screw 3.

The bottom of the hopper 1 may be provided with a grilled zone 18 which is constantly cleaned by the helices of the outer screw 3 and which communicates with a small box 118 fixed on the outside of the said hopper and provided with a pipe 218 for discharging any liquid which, owing to the presence of the step existing between the said bottom of the hopper and the lowest part of the compaction stator 15, would tend to stagnate inside the said hopper. As an alternative to this solution it is possible to use the solution which is described in Italian Utility Model application No. BO2004-U78 in the name of the same Applicant and which envisages an orifice for discharging the liquids, situated in the bottom part of the wall 201 of the hopper, namely in the bottom part of the flange 106 and closed with suitable play by an extension of the plate 203 of the feeder screw 3, which will be provided with scrapers for constant cleaning of the said play and the said liquid discharge orifice.

Figure 1:
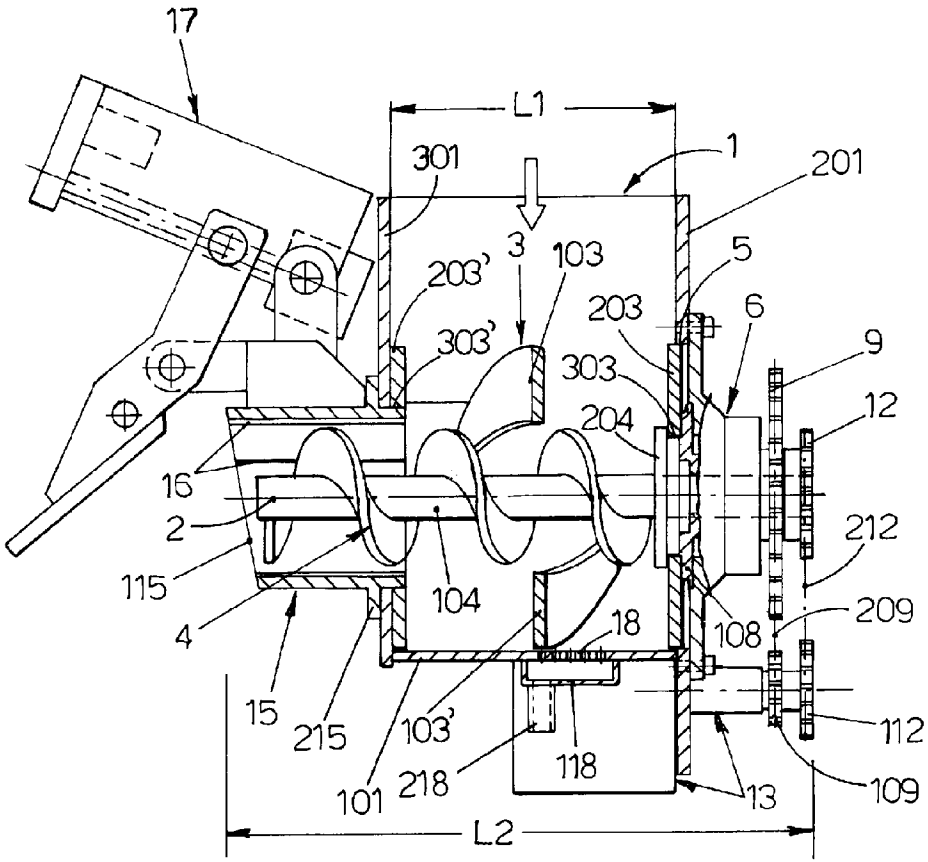
FIG. 1 is a side view of the twin-screw press in question, sectioned along a vertical plane containing the axis of rotation of the said screws.
Figure 2:
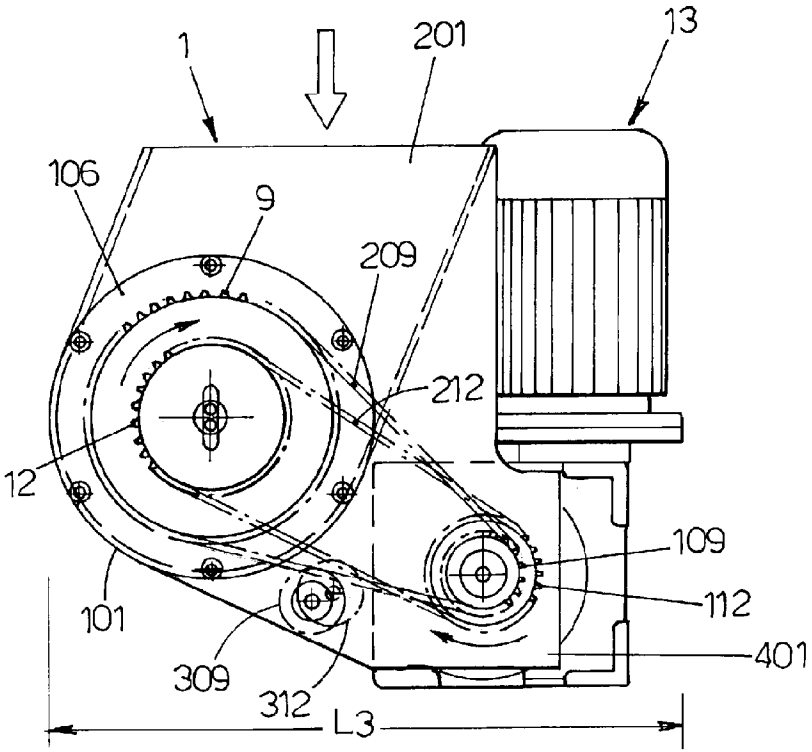
FIG. 2 shows the press according to FIG. 1 in an elevation view from the screw driving end.

Purely by way of a non-limiting example, as shown in FIG. 1, the length L1 of the outer screw 3 may be in the region of about 240 mm, while the length L2 of the entire screw system may be about 500 mm. The end dimension L3 of the press, as can be seen from FIG. 2, is in the region of 650 mm.

Figure 5:
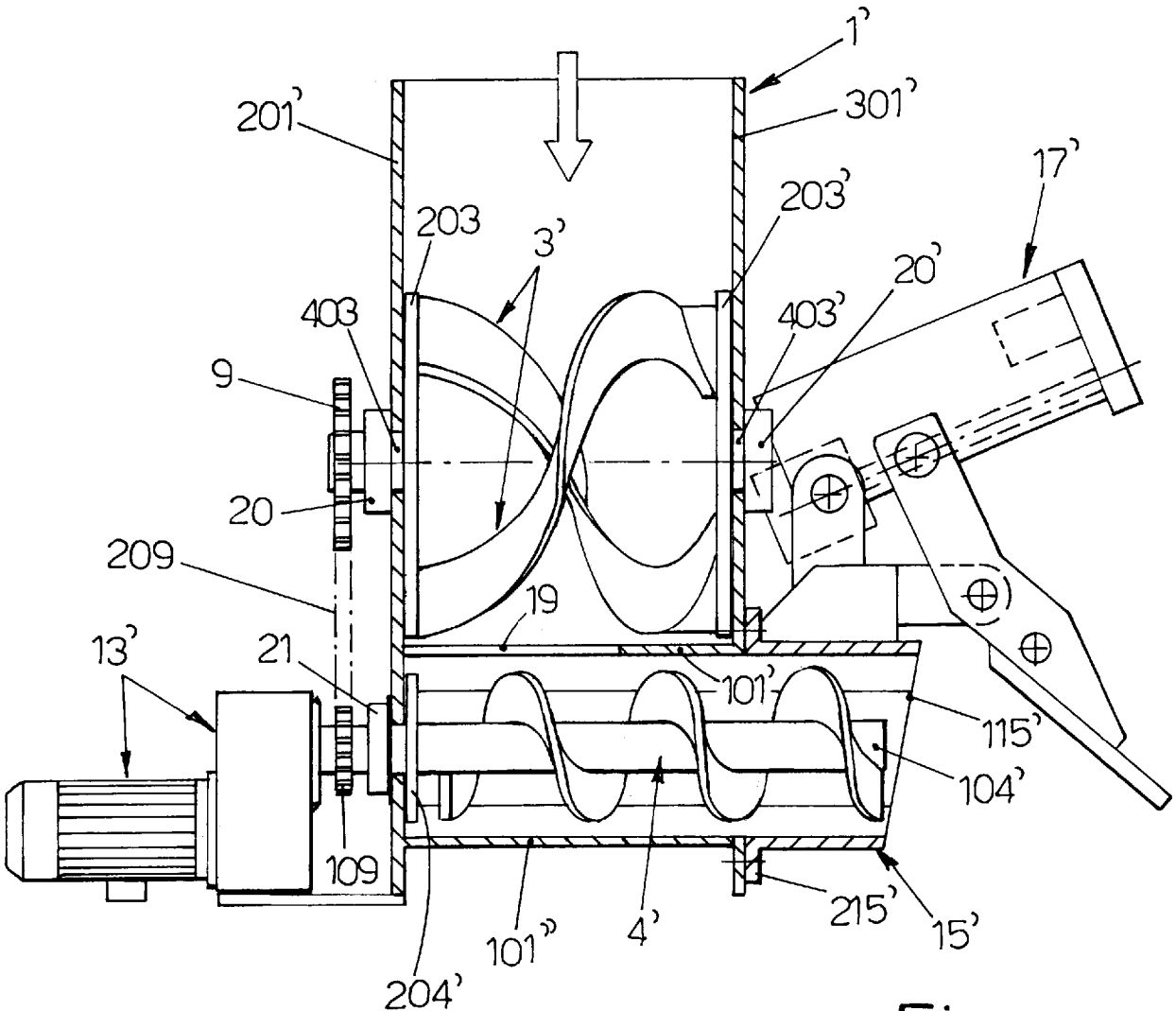
FIG. 5. is a side view, with parts cross-sectioned, of a variation of embodiment of the press comprising two separated screws.
Figure 7:
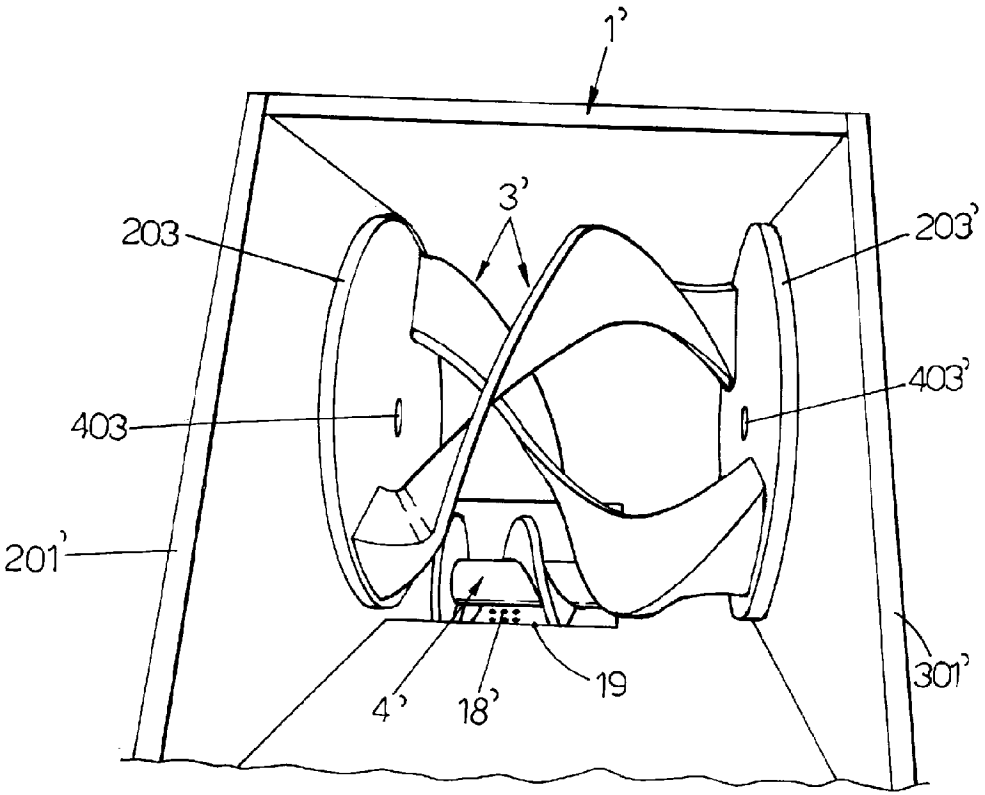
FIG. 7 shows a perspective view, from above, of the further details of the press according to the variant of FIGS. 5 and 6.
Figure 6:
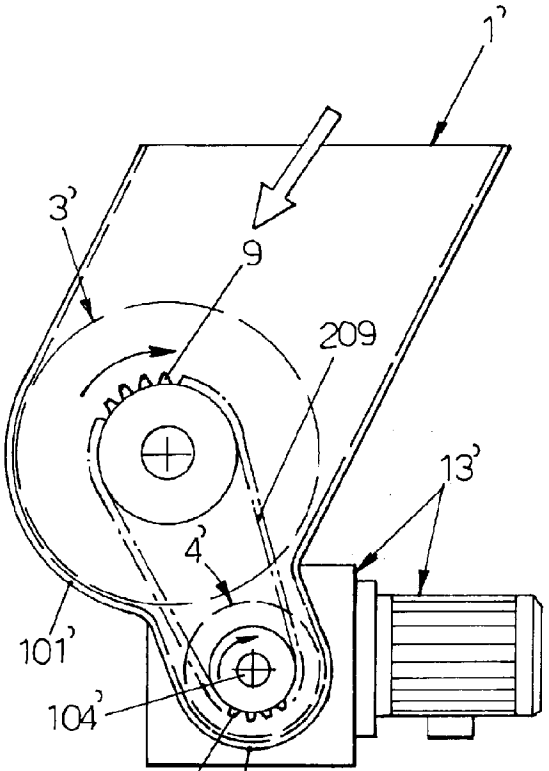
FIG. 6 shows an elevation view of the press according to FIG. 5 from the screw driving end.

With reference to FIGS. 5, 6 and 7, a description now follows of a variation of embodiment of the press also formed by two cylindrical screws of varying diameter and varying pitch, which rotate at different speeds and the lengthwise dimension of which is defined by the compacting screw of the two screws, which has a greater length. Differently from the previous solution, the two screws are arranged above one another and/or situated partly alongside each other, but at different heights. The larger-diameter feeder screw 3' is similar to the previous one, with the sole difference that the direction of extension of its helices is opposite to that of the helix of the compacting screw so that, when the two screws rotate in the same direction, the feeder screw moves the material in a direction opposite to that moved by the said compacting screw. The bottom 101' of the loading hopper 1' is partly rounded along the axis of the feeder screw 3', with any suitable internal and longitudinal scoring (not shown) below and along the side of the said rounded part, and the said hopper is provided, approximately halfway along the length of its bottom (FIG. 7), with a window 19 towards which the said screw 3' pushes the material which is taken up by the compacting screw 4' operating in a lower extension or bottom part 101" of the hopper, which has a rounded profile with a curvature along the axis of the same compacting screw 4'. The end plates 203, 203' of the feeder screw 3' in this case do not have axial holes as in the previous solution and are provided integrally with hubs 403, 403' supported by bearing boxes 20, 20' which are flanged onto the outer side of the end walls 201' and 301' of the hopper 1', and one of these hubs which projects from the associated box has, keyed thereon, the pinion 9 which is in turn connected by means of a chain 209 to the corresponding pinion 109 keyed onto the axis of the actuating gear motor unit 13'. The same hopper wall which supports the said box 20 has a bearing box 21 which supports in a projecting manner the shaft 104' of the compacting screw 4' which in this case also occupies the stator 15' which with its flange 215' is fixed onto the end wall 301' of the hopper 1' and which in this case also is controlled on the discharge mouth 115' by an automatic constriction and compaction device 17'. The shaft 104' of the bottom screw projects from the bearing box 21 and is keyed directly to the slow output shaft of the gear motor unit 13'. In this constructional variant of the press there is no stagnation of any liquid on the bottom of the hopper since the lowest point of the hopper itself is in line with the compacting stator 15' which may therefore perform evacuation of the said liquids together with the compacted material. If necessary, a liquids trap may be formed at the start of the bottom part 101" of the hopper which acts as a housing for the lower screw 4', opposite the window 19 situated above, providing in this bottom part a grilled zone 18' (see FIG. 7) and, on the outside of the latter, a box with discharge spout, similar to that indicated by 118 and 218 in the solution according to FIG. 1. In this case also it is possible to use, for discharging of the liquids, the variation of embodiment described in Italian Utility Model application No. BO2004-U78 in the name of the Applicant, with the arrangement of a discharge orifice situated in the lowest part of the wall 201' of the hopper and concealed with play by an extension of the plate 204' of the compacting screw, this plate being provided with scrapers for the constant cleaning of the said play and the said discharge orifice.

The screw presses have been illustrated in the drawings with a horizontal arrangement, but it is understood that they may be suitably inclined with their longitudinal axis directed upwards or downwards. It is also understood that the description relates to a preferred embodiment of the invention to which numerous variations and modifications, in particular of a constructional nature, may be made, these consisting, for example, in the fact that in both solutions the larger-diameter feeder screw 3 or 3' may have two helices or only one helix which are/is integral in a projecting manner with the single conveyor plate 203 which will be supported by suitably sized bearing boxes.

The invention claimed is:

1. A screw press, with small dimensions, particularly suitable for the compaction of solid waste for disposal, also using sorted-waste collection, the screw press comprising an initial first large-diameter screw section with wide-pitch helices, communicating laterally with a bottom opening of a loading hopper in order to remove material from the hopper and feed the material to a following second small-diameter screw section with small-pitch helices, surrounded by an internally scored stator body so as to produce the feeding and compaction of the material which also occurs in conjunction with the action of a constrictor which acts on the discharge mouth of the second screw section, the first and second screw sections being separated and arranged above one another and/or situated partly alongside each other but at different heights, so as to form overall a press which has a length corresponding to the length of the longer of the two screw sections, the two screw sections being operated at different speeds, with the second screw section rotating at a speed greater than that of the first screw section, and the first screw section having a direction of extension of its helices which is opposite to that of the helices of the second screw section so that, when the two screw sections rotate in the same direction, the first screw section moves the material in the opposite direction to that moved by the second screw section, the loading hopper being provided with a partly rounded bottom having its center on an axis of the first screw section, with inner and longitudinal scoring, and at the bottom and along the side of the rounded part, the hopper being provided, approximately halfway along the length of its bottom, about the distal end of the first screw section, with a window towards which the first screw section pushes the material which is immediately taken up by the second screw section which operates in a lower extension or bottom part of the hopper and has a rounded profile with a curvature along an axis of the second screw section, the axes of the first and second screw sections being parallel to each other, and the diameter of the first screw section being larger than the diameter of the second screw section.

2. A screw press according to claim 1, in which the first screw section has only helical vane(s) and is axially hollow.

3. A screw press according to claim 2, in which the first screw section is formed by two helices which are offset by 180° with respect to each other, which each cover half the pitch and which are welded at their ends to a pair of circular and parallel end plates.

4. A screw press according to claim 3, in which the end plates of the first screw section are provided integrally with hubs supported by bearing boxes flanged onto the outer side of the end walls of the hopper, one of these hubs projecting from the associated bearing box having keyed thereon a pinion which is in turn connected by a chain to a corresponding pinion which is keyed onto a shaft of an actuating gear motor unit, the same wall of the hopper which supports the bearing box also supporting in a projecting manner a shaft of the second screw section, which shaft also occupies a compacting stator which, with a flange is fixed onto the end wall of the hopper, and the discharge mouth of which is controlled by an automatic constriction and compaction device, the shaft of the second screw section projecting from the bearing box and being keyed directly to the shaft of the gear motor unit.

5. A screw press according to claim 1, in which the bottom part of the hopper, which acts as a housing for the second screw section, opposite the window situated above, includes a grilled zone and outside the latter with a box with a discharge spout for the evacuation of any liquid contained in the products to be compacted.

6. A screw press according to claim 4, in which a liquids discharge orifice is provided on the bottom part of the wall of the hopper which supports the pinion, this orifice being concealed by an extension of a plate of the second screw section, which plate is provided with scrapers for the constant cleaning of the discharge orifice.

* * * * *